US005992940A

United States Patent [19]

Chen

[11] Patent Number: 5,992,940

[45] Date of Patent: Nov. 30, 1999

[54] SUPPORT TUBE FOR AN OFFICE CHAIR

[75] Inventor: Yung-Hsiang Chen, Tainan Hsien, Taiwan

[73] Assignee: Jing-Dean Enterprises Co., Ltd., Taipei Hsein, Taiwan

[21] Appl. No.: 09/124,957

[22] Filed: Jul. 29, 1998

[51] Int. Cl.[6] ..... A47C 15/00

[52] U.S. Cl. ..... 297/463.1; 248/161

[58] Field of Search ..... 297/463.1, 463.2, 297/344.12, 344.18, 344.19, 344.21, 344.26; 248/161, 157, 404, 406.2

[56] References Cited

U.S. PATENT DOCUMENTS 3,381,926 5/1968 Fritz et al. .
5,556,170 9/1996 Lai et al. .
5,702,083 12/1997 Lai .
5,833,322 11/1998 Barandiaran .

FOREIGN PATENT DOCUMENTS 3030408 2/1982 Germany ..... 297/463.1

*Primary Examiner*—Milton Nelson, Jr.
*Attorney, Agent, or Firm*—Pro-Techtor-International Services

[57] ABSTRACT

A support tube for an office chair includes an outer tube, an inner tube fitted in the outer tube, and a shaft fitting movably in the inner tube. The inner tube has a spiral continual oil groove formed in an inner surfacer for a substantial portion, and an upper and a lower annular oil limit groove respectively connected with an upper end and a lower end of the spiral continual oil groove to stop lubricating oil in the spiral oil groove from flowing out of the inner tube so as to always enable the shaft rotate and move up and down smoothly relative to the inner tube.

2 Claims, 5 Drawing Sheets

SUPPORT TUBE FOR AN OFFICE CHAIR

BACKGROUND OF THE INVENTION

This invention relates to a support tube for an office chair, particularly to one provided with a comparatively good lubricating effect, with lubricating oil not flowing out of the support tube.

Generally speaking, a support tube for a conventional office chair, as shown in FIG. 1, not only supports a seat A and connected between the seat A and a base frame C, but also enables the seat A rotate for 360 degrees so as to adjust the height of the seat A to suit the body height of a user.

The support tube for a conventional office chair, as shown in FIG. 2, includes an outer tube D, an inner tube E fitted in the outer tube D, and a shaft F fitting movably in the inner tube E and fixed with a lower end of the outer tube D at its lower end. And an upper end of the shaft F is fixed firmly with the bottom of the seat A.

However, rotation of the seat A and adjustment of the seat height is effected by means of lubricating oil filled on an outer surface of the shaft F and an inner surface of the inner tube E. But as the outer surface of the shaft F and the inner surface of the inner tube E closely fit with each other, without any aperture for lubricating oil to stay thereon and to liable to overflow out of the inner tube E. Then the shaft F and the inner tube E may not get good lubricating effect.

SUMMARY OF THE INVENTION

The purpose of the invention is to offer a support tube for an office chair, having a kind of structure to always keep some lubricating oil on the inner surface of the inner tube, with the lubricating oil not flowing out thereof, enabling a shaft to rotate and move up and down smoothly relative to the inner tube.

The main feature of the invention is the inner tube provided with a spiral continual oil groove formed in a substantial portion of the inner surface of the inner tube, an upper annular oil limit groove connected with an upper end of the spiral oil groove, and a lower annular oil limit groove connected with a lower end of the spiral continual oil groove. Then there is always lubricating oil staying in the spiral continual oil groove and in the upper and the lower annular oil limit groove to permit the shaft to rotate and move up and down smoothly relative to the inner tube. In addition, the lubricating oil is prevented from flowing up or down out of the inner tube by means of the upper and the lower annular oil limit groove.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
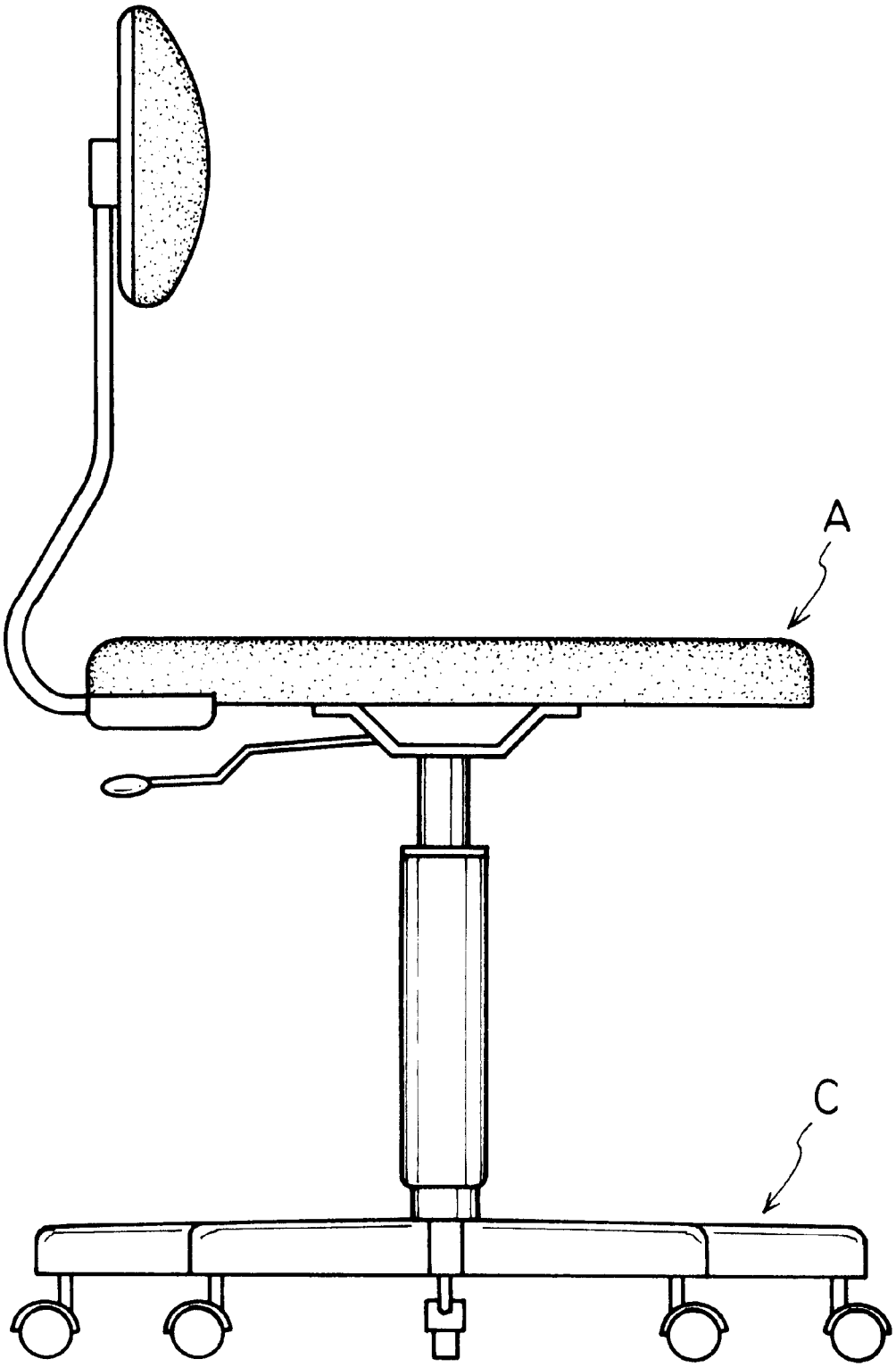
FIG. 1 (PRIOR ART)
FIG. 1 is a side view of a conventional known office chair.
Figure 2:
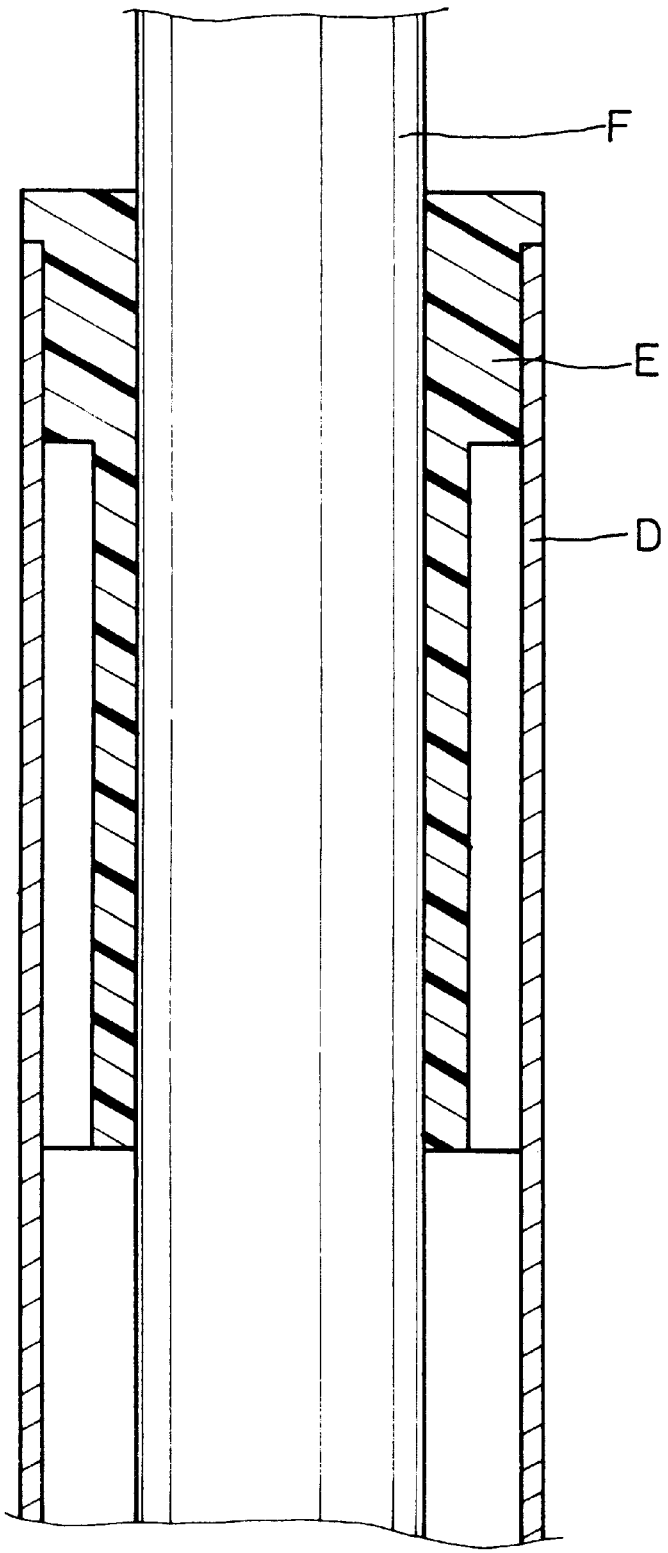
FIG. 2 (PRIOR ART)
FIG. 2 is a cross-sectional view of a support tube of the conventional known office chair.
Figure 3:
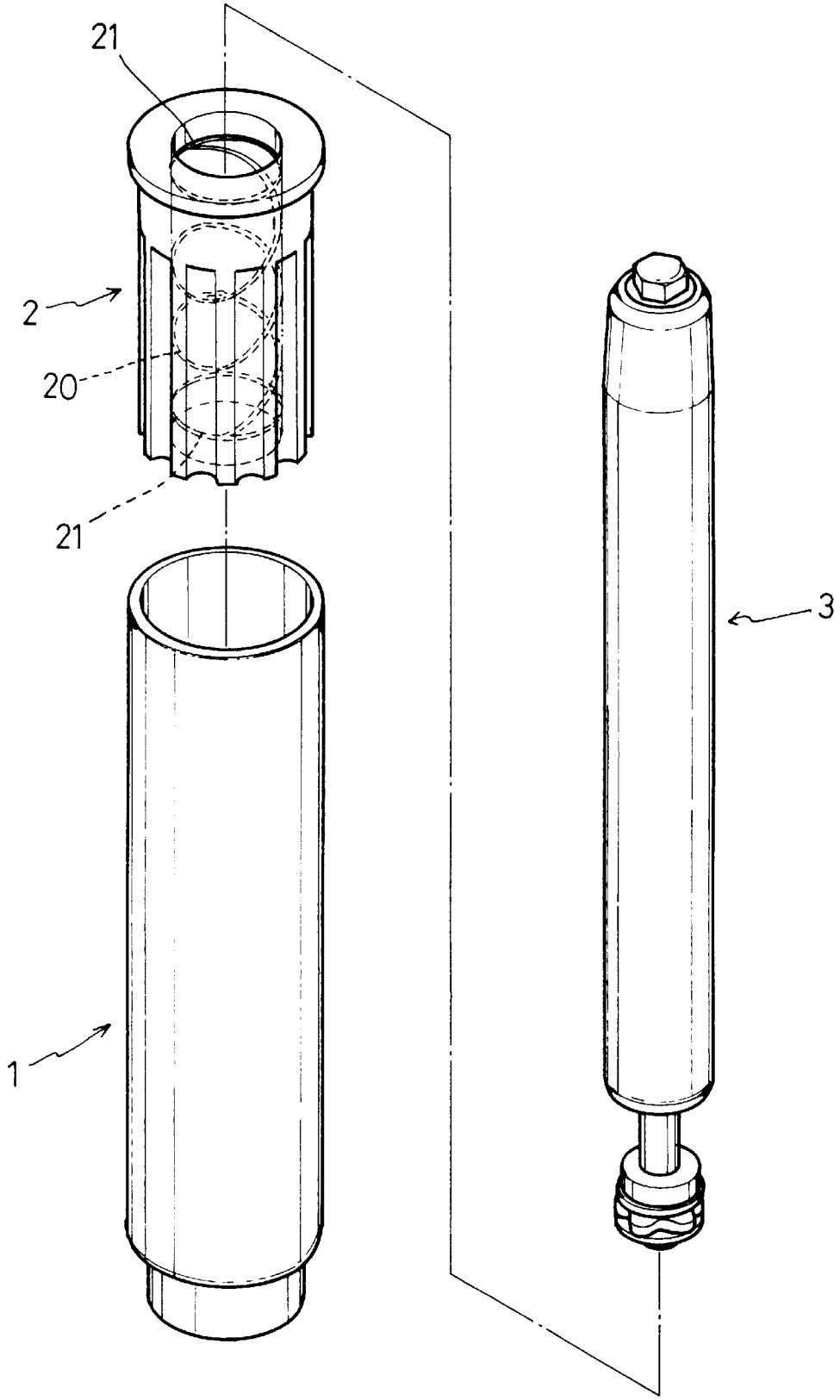
FIG. 3 is an exploded perspective view of a first embodiment of a support tube for an office chair in the present invention.

A first preferred embodiment of a support tube for an office chair in the present invention, as shown in FIG. 3, includes an outer tube 1, an inner tube 2 fitting in the outer tube 1, and a shaft 3 fitting in the inner tube 2 and exposes out to be fixed with the outer tube 1, as the same structure of the conventional known support tube for an office chair described above.

Figure 4:
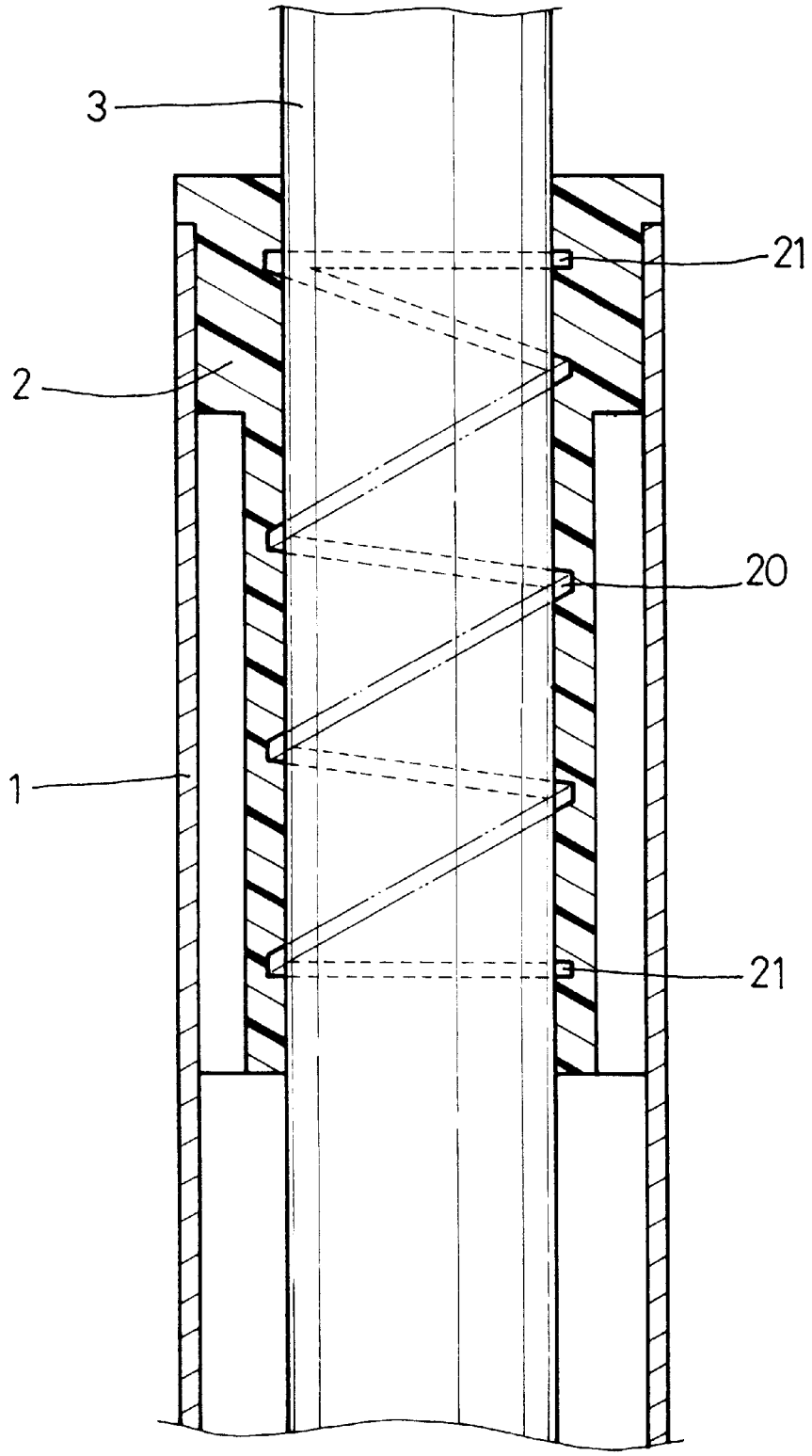
FIG. 4 is a partial cross-sectional view of the first embodiment of a support tube for an office chair in the present invention; and, FIG. 5 is a partial lengthwise cross-sectional view of a second embodiment of a support tube for an office chair in the present invention.

An improved feature of the present invention, as shown in FIG. 4, is the inner tube 2 has a spiral continual oil groove 20 formed in a substantial portion of an inner surface, and an upper and an lower annular oil limit groove 21, 21 respectively connected with an upper end and a lower end of the spiral continual oil groove 20. Therefore, lubricating oil can stay in the spiral continual oil groove 20 and stopped by the upper and the lower annular limit groove 21, 21, impossible to flow out of the inner tube 2, always keeping lubricating oil exist between the outer surface of the shaft 3 and the inner surface of the inner tube 2 so as to permit the shaft 3 rotate and move up and down smoothly relative to the inner tube 2.

Figure 5:
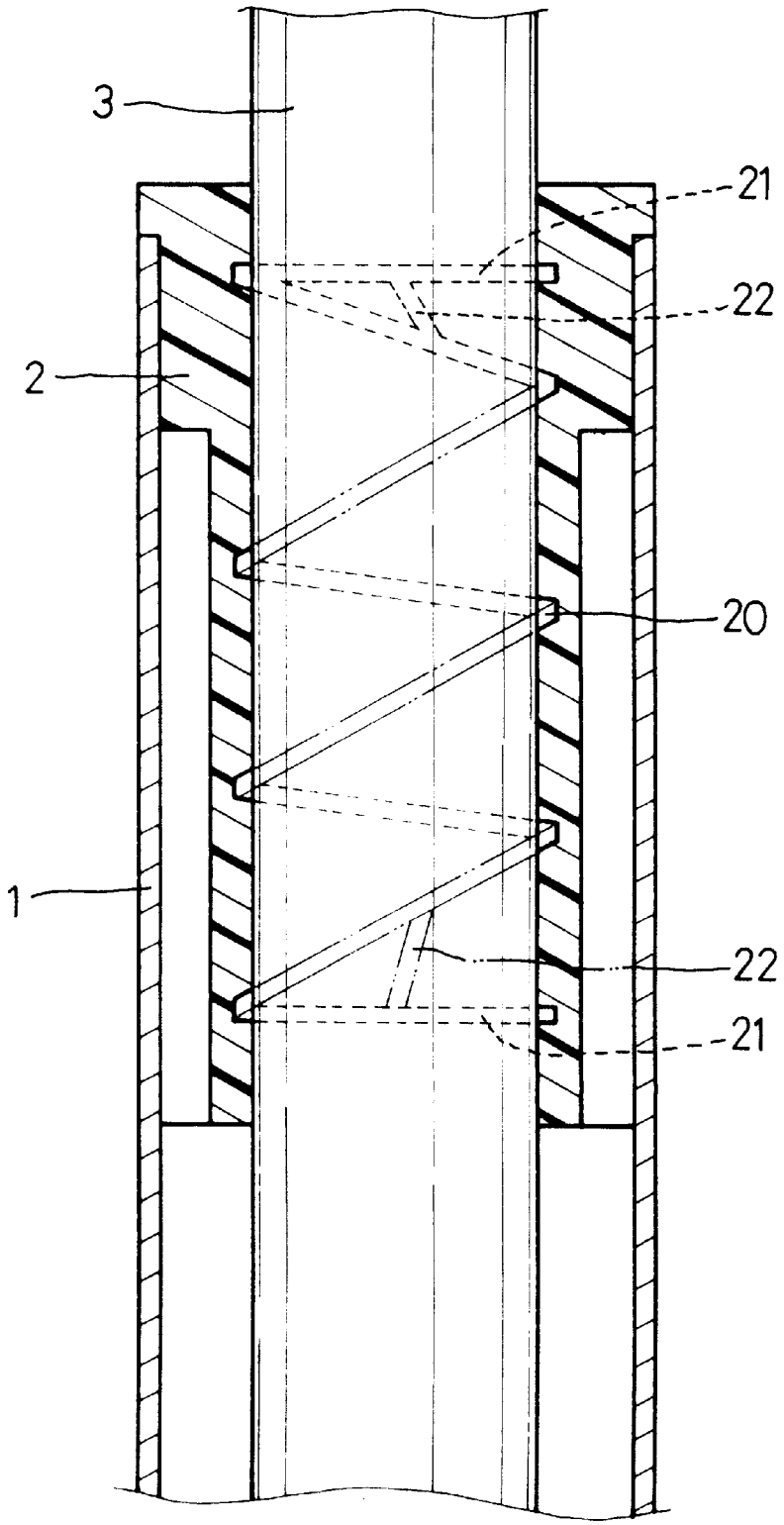

A second preferred embodiment of the invention is shown in FIG. 5, has a difference only in one or more connecting grooves 22 are additionally formed between the spiral continual oil groove 20 and the upper and the lower annular oil limit groove 21 and 21 so as to disperse lubricating oil for providing with better lubricating effect for the shaft 3 and the inner tube 2.

While the preferred embodiment of the invention have been described above, it will be recognized and understood that various modifications may be made therein and the appended claims are intended to cover all such modifications which may fall within the spirit and scope of the invention.

What is claimed is:

1. A support tube for an office chair comprising:

an outer tube, an inner tube fitted in said outer tube, and a shaft movably secured within said inner tube, said shaft is fixed to a lower end of said outer tube; wherein said inner tube has a spiral continual oil groove formed in a substantial portion of an inner surface, an upper annular oil limit groove formed at an upper end of and in communication with said spiral continual oil groove, and a lower annular oil limit groove formed at a lower end of and in communication with said spiral continual oil groove, said upper and said lower annular oil limit grooves preventing lubricating oil contained in said spiral continual oil groove from flowing out of said inner tube, so that said shaft is always lubricated so as to rotate and move up and down smoothly relative to said inner tube.

2. The support tube for an office chair as claimed in claim 1, wherein:

at least one connecting oil groove is formed between said upper annular oil limit groove and said lower annular oil limit groove and said spiral continual oil groove so as to disperse said lubricating oil to provide an improved lubricating effect for said shaft and said inner tube.

* * * * *